US007445039B2

(12) United States Patent
Hou et al.

(10) Patent No.: US 7,445,039 B2
(45) Date of Patent: Nov. 4, 2008

(54) HEAT PIPE WITH MULTIPLE VAPOR-PASSAGES

(75) Inventors: Chuen-Shu Hou, Tu-Cheng (TW); Tay-Jian Liu, Tu-Cheng (TW); Chao-Nien Tung, Tu-Cheng (TW); Chih-Hsien Sun, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 151 days.

(21) Appl. No.: 11/309,262

(22) Filed: Jul. 20, 2006

(65) Prior Publication Data

US 2007/0107877 A1 May 17, 2007

(51) Int. Cl.
*F28D 15/00* (2006.01)
*H05K 7/20* (2006.01)

(52) U.S. Cl. ..... 165/104.26; 165/104.21

(58) Field of Classification Search ..... 165/104.21, 165/104.26, 104.33, 140, 141; 361/700; 257/715; 174/15.2
See application file for complete search history.

(56) References Cited

U.S. PATENT DOCUMENTS 3,414,475 A * 12/1968 Fiebelmann ..... 376/424
3,786,861 A * 1/1974 Eggers ..... 165/104.26
4,109,709 A * 8/1978 Honda et al. ..... 165/104.26
4,441,548 A * 4/1984 Franklin et al. ..... 165/104.26
5,046,553 A * 9/1991 Lindner ..... 165/104.26
5,632,158 A * 5/1997 Tajima ..... 62/259.2
2004/0188067 A1* 9/2004 Chau et al. ..... 165/104.26

FOREIGN PATENT DOCUMENTS

| | | |
|---|---|---|
| CN | 2735283 | 10/2005 |
| DE | 2252994 | 5/1974 |
| WO | 2004094933 | 11/2004 |

* cited by examiner

*Primary Examiner*—Tho V Duong
(74) *Attorney, Agent, or Firm*—Frank R. Niranjan

(57) ABSTRACT

A heat pipe includes a metal casing (100) filled with a working fluid therein, a capillary wick (200) provided inside of the metal casing and a tube (300) contacting with a surface of the capillary wick. The capillary wick extends in an axial direction of the casing. A plurality of spaced vapor passages (700) is formed by the capillary wick in the casing and a liquid channel (800) is defined by the capillary wick. The working fluid in vapor state flows along the vapor passages and the working fluid in liquid state flows along the liquid channel. The tube separates the vapor from the liquid at a place where the tube is located.

13 Claims, 5 Drawing Sheets

HEAT PIPE WITH MULTIPLE VAPOR-PASSAGES

FIELD OF THE INVENTION

The present invention relates generally to heat pipes as heat transfer/dissipating device, and more particularly to a heat pipe forming spaced multiple vapor passages therein.

DESCRIPTION OF RELATED ART

Heat pipes have excellent heat properties, and therefore are an effective means for heat transfer or dissipation from heat sources. Currently, heat pipes are widely used for removing heat from heat-generating components such as central processing units (CPUs) of computers. FIGS. 4-5 show an example of a heat pipe in accordance with related art. The heat pipe includes a vacuum casing 10 containing a working fluid therein (not shown) and a capillary wick 20 attached to an inner surface of the casing 10. The casing 10 includes an evaporating section 40 at one end and a condensing section 60 at the other end. An adiabatic section 50 may be provided between the evaporating and condensing sections 40, 60. The adiabatic section 50 is typically used for transport of the generated vapor from the evaporating section 4 to the condensing section 60. A vapor channel 70 is formed in a central of an inside of the casing 10 and a looped liquid channel 80 is defined by the capillary wick 20. As the evaporating section 40 of the heat pipe is maintained in thermal contact with a heat-generating component, the working fluid contained in the evaporating section 40 absorbs heat generated by the heat-generating component and then turns into vapor. Due to the difference of vapor pressure between the evaporating and condensing sections 40, 60 of the heat pipe, the generated vapor moves towards and carries the heat simultaneously to the condensing section 60 along the vapor channel 70. The vapor is condensed into liquid at the condensing section 60 after releasing the heat into ambient environment. FIG. 5 is a diagrammatically longitudinal cross-sectional view showing opposite flowing paths between vapor and condensed liquid of the working fluid in the casing 10 of the heat pipe. Because of contacts of the vapor and the condensed liquid, an entrainment limit caused by the opposite flowing between the vapor and the condensed liquid prevents circulations of the vapor and condensed liquid. The condensed liquid is heated before it reaches the evaporating section 40. Accordingly, heat-transferred ability of the heat pipe is weakened and heat dissipation efficiency of the heat pipe is lowered.

In view of the above-mentioned disadvantage of the conventional heat pipe, there is a need for a heat pipe having a good heat transfer effect.

SUMMARY OF THE INVENTION

A heat pipe in accordance with a preferred embodiment includes a metal casing filled with a working fluid therein, a capillary wick provided inside of the metal casing and a tube contacting with a surface of the capillary wick. The capillary wick extends in an axial direction of the casing. A plurality of spaced vapor passages is formed by the capillary wick in the casing and a liquid channel is defined by the capillary wick. Vapor flows from first end to second end of the heat pipe along the vapor passages, while liquid flows from the second end to the first end along the liquid channel.

Other advantages and novel features will become more apparent from the following detailed description of preferred embodiments when taken in conjunction with the accompanying drawings, in which:

BRIEF DESCRIPTION OF THE DRAWINGS

Many aspects of the present apparatus and method can be better understood with reference to the following drawings. The components in the drawings are not necessarily drawn to scale, the emphasis instead being placed upon clearly illustrating the principles of the present apparatus and method. Moreover, in the drawings, like reference numerals designate corresponding parts throughout the several views.

DETAILED DESCRIPTION OF THE INVENTION

Figure 1:
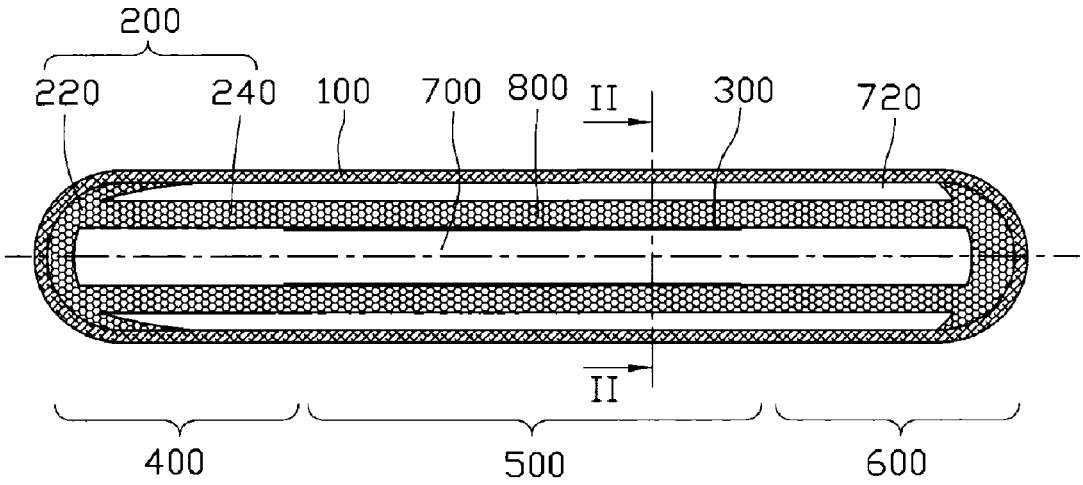
FIG. 1 is a longitudinal cross-sectional view of a heat pipe in accordance with a first embodiment of the present invention.
Figure 2:
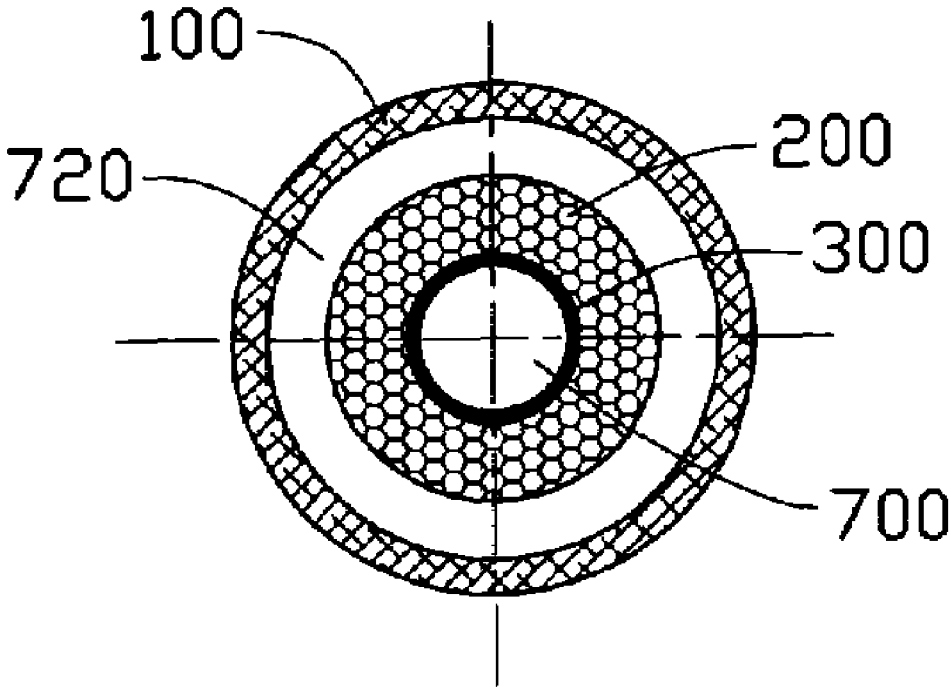
FIG. 2 is a radial cross-sectional view of the heat pipe in accordance with the first embodiment, taken along line 11-11 of FIG. 1.

FIGS. 1-2 show a heat pipe in accordance with a first embodiment of the present invention. The heat pipe comprises a metal casing 100 made of highly thermally conductive materials such as copper or copper alloys, a working fluid (not shown) contained in the casing 100 and a capillary wick 200 arranged inside of the casing 100. The casing 100 comprises an evaporating section 400 at one end, a condensing section 600 at the other end and an adiabatic section 500 arranged between the evaporating section 400 and the condensing section 600. The capillary wick 200 comprises first capillary wicks 220 disposed in opposite ends of the casing 100 and a second capillary wick 240 interconnecting with the first capillary wicks 220. The first capillary wicks 220 are arranged on the evaporating and condensing sections 400, 600 of the casing 100. The first capillary wick 220 at the evaporating section 400 has an outer periphery (not labeled) with a gradually decreased thicknesses extending towards the adiabatic section 500 of the casing 100. An end of the outer periphery of the first capillary wick 220 at the evaporating section 400 which is much thinner than the second capillary wick 240 extends into a second vapor passage 720 thereby to guide the vapor at the evaporating section 400 to flow into the second vapor passage 720. The second capillary wick 240 extends in an axial direction of the casing 100 and a first vapor passage 700 is formed in the second capillary wick 240 in the center of the casing 100. The second vapor passage 720 is provided between an outer wall of the second capillary wick 240 and an inner wall of the casing 100 to form an annular section in a radial cross-sectional view of the heat pipe. The first and second vapor passages 700, 720 are concentric to each other. The second vapor passage 720 is separated from the first vapor passage 700 by the capillary wick 200. A liquid channel 800 is defined by the capillary wick 200. A tube 300 is arranged in the first vapor passage 700 at the adiabatic section 500 and an outer wall of the tube 300 is attached with an inner surface of the second capillary wick 240 defining the first vapor passage 700. The tube 300 is disposed on the second capillary wick 240 of the adiabatic section 500 of the casing 100. The vapor passage 700 is separated from the second capillary wick 240 by the tube 300 at the adiabatic section 500. The tube 300 can reach the evaporating and condensing sections 400, 600 with a proper range. The tube 300 is made of metal or one of plastics and resin.

As the evaporating section 400 of the heat pipe is maintained in thermal contact with a heat-generating component (not shown), the working fluid contained in the evaporating section 400 absorbs heat generated by the heat-generating component and then turns into vapor. Due to the difference of vapor pressure between the evaporating and condensing sections 400, 600 of the heat pipe, the generated vapor moves along the first and second vapor passages 700, 720 and carries the heat simultaneously to the condensing section 600. The vapor is condensed into liquid at the condensing section 600 after releasing the heat into ambient environment. Because of an arrangement of the tube 300 attached on the second capillary wick 240 at the adiabatic section 500, the vapor and the liquid in the adiabatic section 50 are separated by the metal tube 300, which can avoid the adverse contact between the vapor and liquid. Thus, the condensed working fluid from the condensing section 600 can smoothly reach the evaporating section 400 and is prevented from being heated by the high temperature vapor at the adiabatic section 500. Abilities of heat-absorption and heat-dissipation of the working fluid of the heat pipe are enhanced and heat-transfer efficiency of the heat pipe is accordingly improved.

Figure 3:
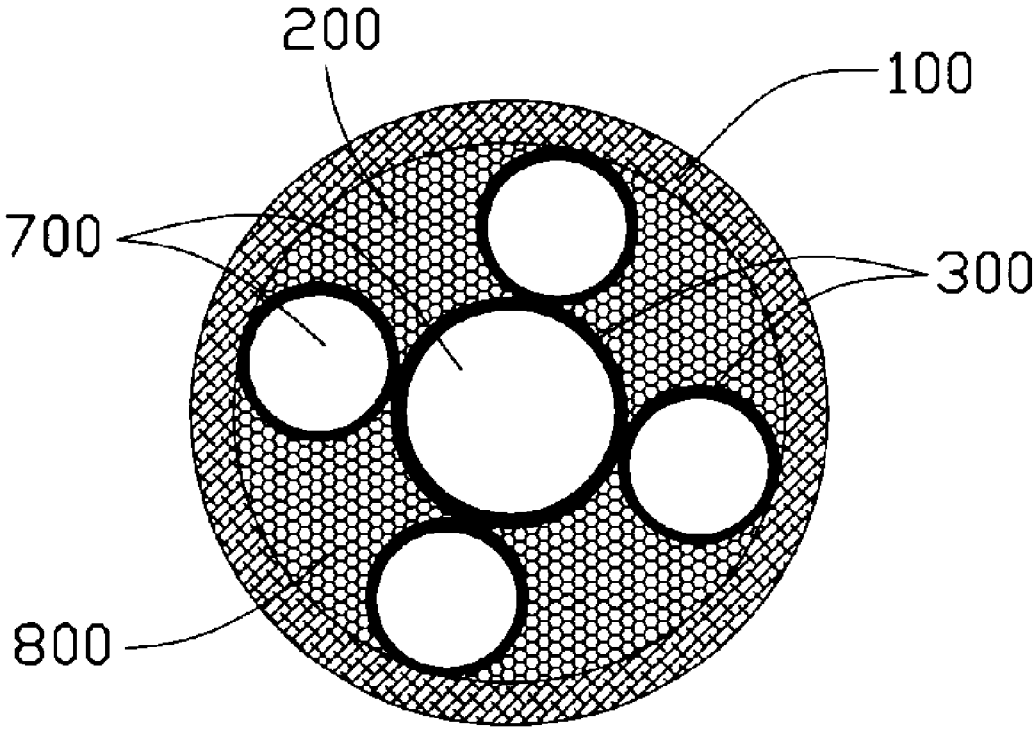
FIG. 3 is a radial cross-sectional view of a heat pipe in accordance with another embodiment of the present invention.
Figure 4:
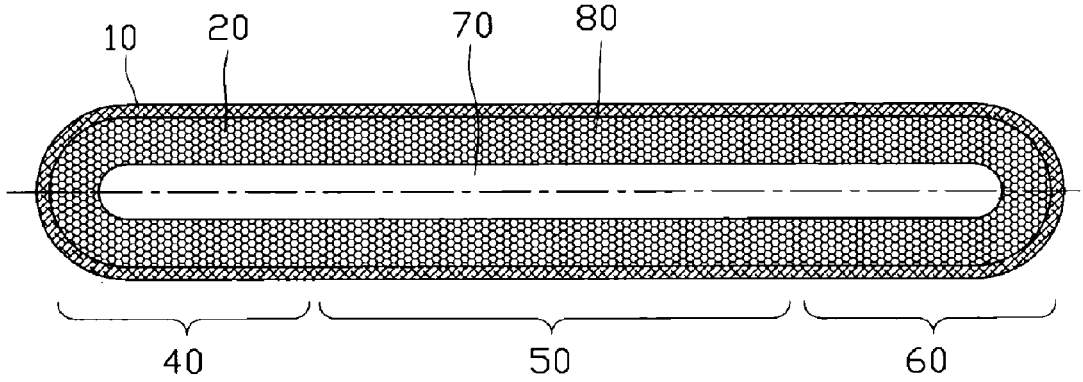
FIG. 4 (RELATED ART)
FIG. 4 is a longitudinal cross-sectional view of a heat pipe in accordance with related art.
Figure 5:
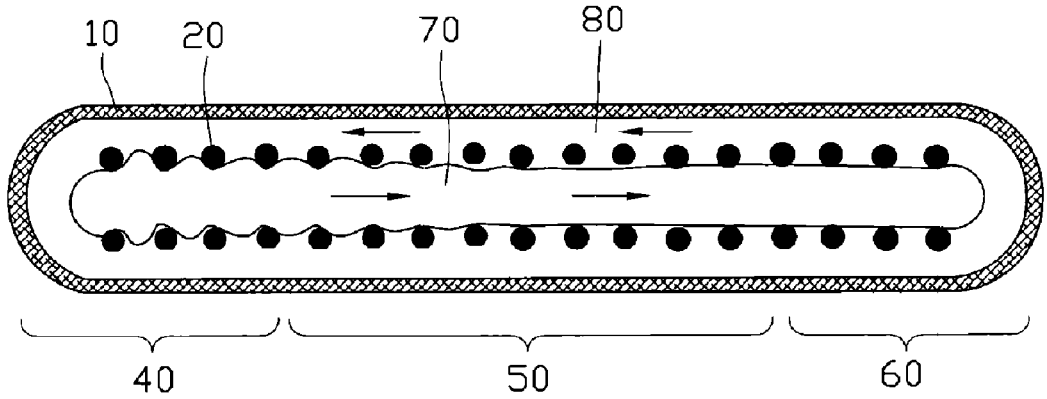
FIG. 5 (RELATED ART)
FIG. 5 is a diagrammatically longitudinal cross-sectional view showing vapor and liquid moving paths of the related heat pipe of FIG. 4.

FIG. 3 illustrates a heat pipe according to another embodiment of the present invention. The capillary wick 200 defines five tube-shaped cavities (not labeled) in the casing 100. The five tube-shaped cavities comprise a bigger cavity (not labeled) in the center of the casing 100 and four smaller cavities (not labeled) disposed around the bigger cavity. Five tubes 300 are inserted into the respective cavities and outer surfaces of the tubes 300 are attached to inner surfaces of the capillary wick 200 defining the cavities. The five tubes 300 comprises a bigger tube 300 disposed in the center of the casing 100 and four smaller tubes 300 spaced from each other and distributed in the casing 100 around the bigger tube 300. A vapor passage 700 is formed in each of cavities and is separated from the capillary wick 200 by the corresponding tube 300. The liquid channel 800 is defined by the capillary wick 200.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A heat pipe comprising:

a casing having an inner wall therein and defining an evaporating section for receiving heat and a condensing section for releasing the heat;

a working fluid received in the casing and evaporated into vapor in the evaporating section and condensed into liquid in the condensing section;

a capillary wick received in the casing and extending in an axial direction of the casing, the capillary wick defining a liquid channel therein;

a plurality of vapor passages defined by the capillary wick; and at least a tube arranged in at lease one of the plurality of vapor passages and attached to a surface of the capillary wick;

wherein the at least one of the vapor passages is separated from the capillary wick by the at least a tube, the working fluid in vapor and liquid states respectively flowing along the vapor passages and the liquid channel from one end towards an opposing end of the casing in opposite directions;

wherein the capillary wick comprises first capillary wicks provided in opposite ends of the casing and a second capillary wick interconnecting with the first capillary wicks; and wherein the first capillary wick at the evaporating section is attached to the inner wall of the casing and has an outer periphery with a gradually decreased thickness towards an adiabatic section of the casing disposed between the evaporating section and the condensing section of the casing.

2. The heat pipe as claimed in claim 1, wherein the vapor passages are formed in the capillary wick and each vapor passage is separated from the capillary wick by a corresponding tube received said each vapor passage.

3. The heat pipe as claimed in claim 1, wherein the tube is made of metal.

4. The heat pipe as claimed in claim 1, wherein the tube is made of one of plastics and resin.

5. The heat pipe as claimed in claim 1, wherein the vapor passages comprise a first vapor passage formed in the second capillary wick and a second vapor passage formed between the second capillary wick and the inner wall of the casing, the tube being inserted into the first vapor passage and contacting with the second capillary wick.

6. The heat pipe as claimed in claim 5, wherein the first vapor passage is located at a center of the casing.

7. The heat pipe as claimed in claim 6, wherein the second vapor passage has an annular configuration.

8. The heat pipe as claimed in claim 7, wherein the outer periphery of the first capillary wick at the evaporating section extends into the second vapor passage thereby guiding the working fluid in vapor generated at the evaporating section into the second vapor passage.

9. A heat pipe comprising:

a tubular casing having an evaporating section for absorbing heat, a condensing section for releasing the heat and an adiabatic section between the evaporating section and the condensing section;

a capillary wick received in the casing, defining a plurality of vapor passages;

a working fluid received in the casing, the working fluid becoming vapor at the evaporating section, the vapor flowing along the vapor passages to the condensing section via the adiabatic section and condensing into liquid at the condensing section, the liquid flowing back to the evaporating section along the capillary wick; and at least a tube received in at least one of the vapor passage to separate the vapor from the liquid;

wherein the capillary wick at the evaporating section is attached to an inner wall of the tubular casing and has an outer periphery with a gradually decreased thickness extending towards the adiabatic section of the tubular casing.

10. The heat pipe as claimed in claim 9, wherein the vapor passages are concentric to each other.

11. The heat pipe as claimed in claim 10, wherein the at least one tube is received in a central one of the concentric vapor passages.

12. The heat pipe as claimed in claim 9, wherein the at least a tube is located at the adiabatic section.

13. The heat pipe as claimed in claim 9, wherein the vapor passages are neighboring to each other with each of the vapor passages being provided with a tube therein to separate the vapor from the liquid.

* * * * *